United States Patent [19]

Squires et al.

[11] 4,424,605

[45] Jan. 10, 1984

[54] SLIDING DOOR TRACK ASSEMBLY INCLUDING A TRACK COVER AND MOUNTING SUPPORTS

[75] Inventors: George Squires, Madison; Charles Bland, Beloit, both of Wis.

[73] Assignee: Combo Corporation, Walkerton, Ind.

[21] Appl. No.: 348,750

[22] Filed: Feb. 16, 1982

[51] Int. Cl.[3] ..... E05D 13/02

[52] U.S. Cl. ..... 16/94 R; 16/95 R

[58] Field of Search ..... 16/87.4 R, 94 R, 94 D, 16/95 R, 95 W, 95 D, 95 DW, 96 R, 96 D, 96 L, 102

[56] References Cited

U.S. PATENT DOCUMENTS

| | | | |
|---|---|---|---|
| 1,036,589 | 8/1912 | Eggleston | 16/94 R |
| 1,051,426 | 1/1913 | Matheson | 16/94 R |
| 1,547,707 | 7/1925 | Willard | 16/95 R |
| 3,242,535 | 3/1966 | Ferris | 16/95 R X |
| 3,636,588 | 1/1972 | Ferris | 16/102 X |

*Primary Examiner*—Fred Silverberg

*Attorney, Agent, or Firm*—Ronald E. Barry

[57] ABSTRACT

A sliding door support assembly having a preassembled track assembly including a split cylindrical elongate track having a flat surface on the top and a number of mounting brackets secured to the flat surface at spaced intervals and a number of support members for supporting an elongate track cover, the support members being mounted on said track assembly after the door has been mounted in the track assembly and being selected to correspond to a particular type of track cover.

4 Claims, 6 Drawing Figures

SLIDING DOOR TRACK ASSEMBLY INCLUDING A TRACK COVER AND MOUNTING SUPPORTS

BACKGROUND OF THE INVENTION

Farm buildings and industrial storage buildings are generally provided with track hung sliding doors that are movable across the face of the wall of the buildlng to block a door opening provided in the wall. The door openings may either have a single sliding door or double sliding doors in order to close the opening. The support structure for the doors generally included a circular or box type track member having mounting brackets with integral track cover support extensions secured to the top of the track member. Since the track cover extensions were permanently mounted on the support structure, the user was limited to a track cover that corresponded to the extensions.

SUMMARY OF THE INVENTION

The support assembly according to the present invention combines the advantages of both its circular and box type tracks in a preassembled track assembly. The assembly includes a track having a number of mounting brackets secured at spaced intervals across the top of the track. The track rather than being circular includes a flat section at the top to provide a mounting surface for the brackets and is opened at the bottom to allow space for the rollers for the sliding doors. The track and mounting brackets are mounted as a unit on a track plank provided on the building wall. The door can be hung on the track prior to putting the track cover support members on the track assembly. A number of different types of support members are provided for various types of track covers. The support members each include a tab which can be permanently locked in the mounting bracket on the top of the track. With this arrangement a variety of track covers can be used with the support assembly.

DETAILED DESCRIPTION OF THE INVENTION

Figure 1:
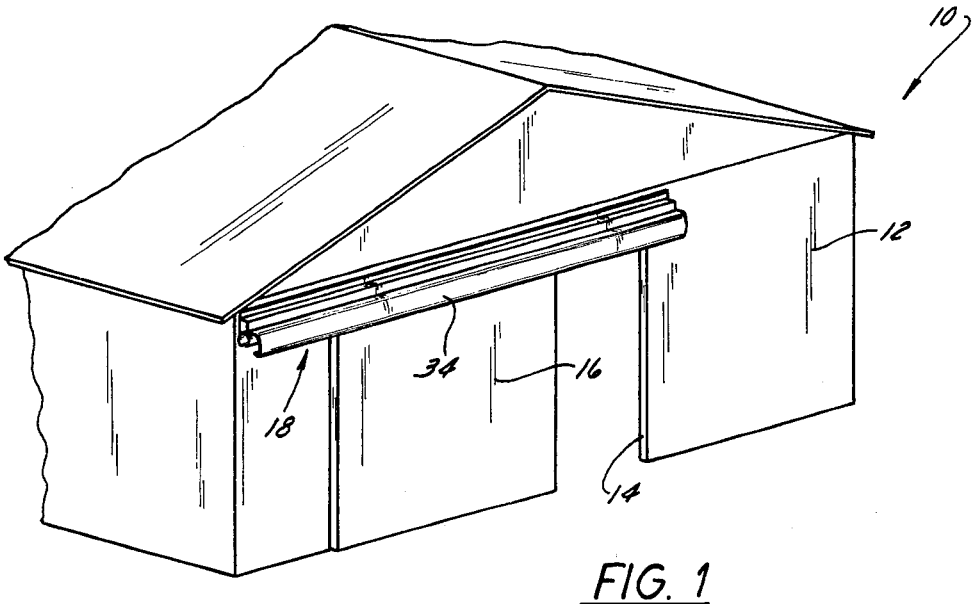
FIG. 1 is a fragmentary perspective view of a typical building structure provided with a sliding door supported by a track assembly according to the present invention.

Referring to FIG. 1 a building structure of a type which may be used as a barn, garage or industrial storage building is indicated generally at 10. It includes a front wall 12 which is normally provided with a door opening 14. A door 16 is shown supported on the sliding door track assembly 18 of the present invention. The door opening 14 is opened or closed by sliding movement of the door across the face of the building wall.

Figure 2:
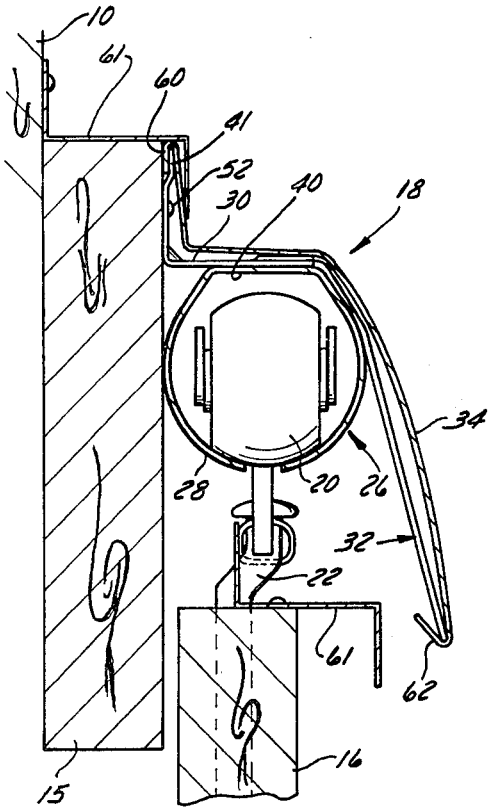
FIG. 2 is an end view of the track assembly shown mounted on the wall of the building.

As seen in FIG. 2 the door 16 is suspended from the track assembly 18 by means of a number of rollers 20 having hanger bolts 22 secured to the top of the door. The hanger bolts may be of the type which can be rotated through a 180° in order to adjust the spacing of the door from the building wall.

Figure 4:
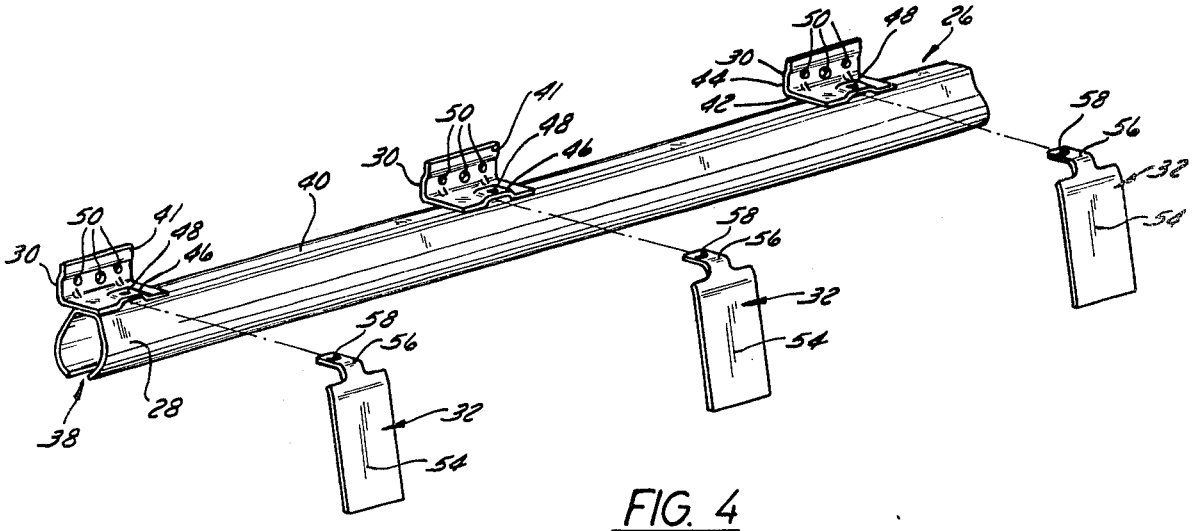
FIG. 4 is a perspective view of the track assembly with the cover support members aligned in a position to be inserted into the mounting brackets.
Figure 5:
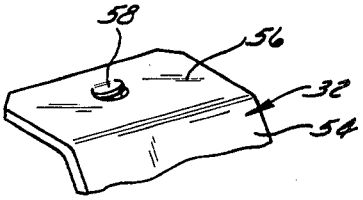
FIG. 5 is a fragmentary perspective view showing one of the locking tabs on the support members.
Figure 6:
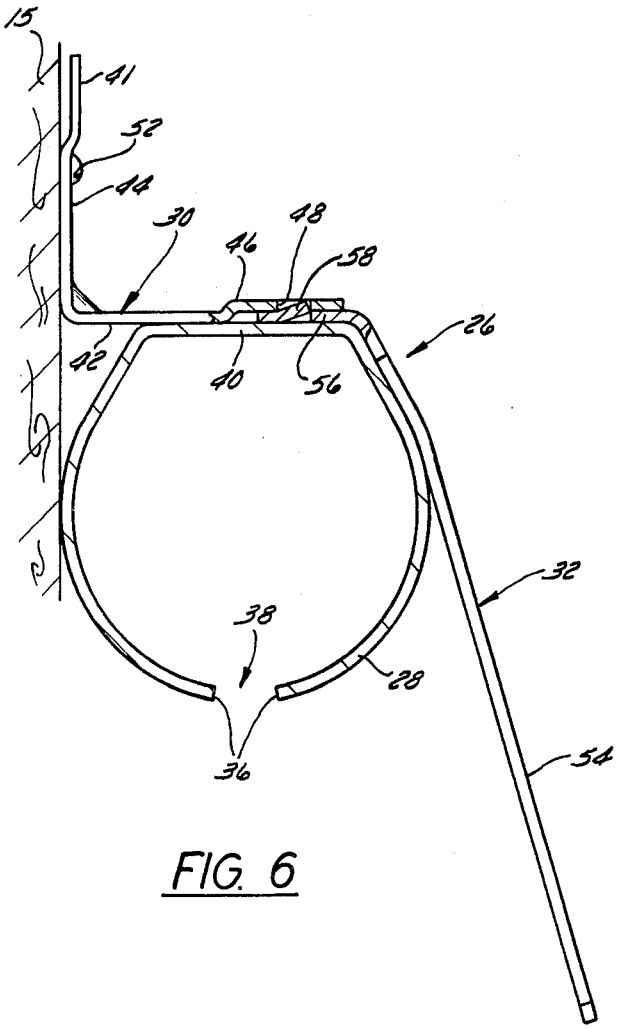
FIG. 6 is an end view of a portion of the track assembly shown partly in section to show one of the support members locked into one of the mounting brackets.

As seen in FIGS. 4, 5, and 6 the track assembly is mounted on a board or track plank 15 provided above the door opening 14. The track assembly includes a track subassembly 26 including a hollow tubular elongate track 28 and a number of mounting brackets 30 secured at spaced intervals to the top of the track 28. A number of track cover support members 32 are positioned to matingly engage the mounting brackets 30.

The track 28 is in the form of a hollow tube having a generally circular configuration with the lower edges 36 of the track located at a spaced interval to define a slot 38 for the hanger bolt 22 on the roller 20. The track 28 includes a flat section 40 on the top to provide a rigid support on the top of the track 28 for the mounting brackets 30. The track 28 thus provides both a circular configuration for the rollers as well as the advantage of a box structure for the mounting brackets.

The mounting brackets 30 are bent at a 90° angle to form a base section 42 and a wall section 44. The base section 42 includes an offset portion 46 in the center of the base section and an opening 48 in the center of the offset portion. The wall section 44 includes an offset lip 41 across the top which is spaced from the board 15 and has a number of mounting holes 50. The bracket 30 is secured to the flat section 40 of the track 28 by means of welds or rivets with the offset portion 46 spaced a distance away from the flat section 40 of the track. The track subassembly 26 is mounted on the board 15 by screwing screws 52 through holes 50 in the brackets 30 into the board 15. When mounted on the plank 15, the wall section should be in a plane tangent to the circular position of the track 28.

The support members 32 each include a main body 54 and a mounting tab 56 that fits in the space between the offset portion 46 and the flat section 40 of the track 28. The tab 56 is provided with a lock element or detent 58 which is partially punched out of the tab 56 and bent upward slightly above the surface of the tab 56. The support member 32 is locked to the bracket 30 by inserting the tab 56 into the offset portion 46 until the lock element or detent 58 engages the hole 48 to permanently lock the support member in the top of the track 28.

The support assembly is covered by means of the track cover 34 as seen in FIG. 2 which extends from the top of the mounting bracket 30 to the bottom of the support member 32. The cover 34 is provided with a lip 60 bent back from the upper end that fits in the space behind the offset lip 41 provided at the top of the bracket and a bent lip or tab 62 at the lower end of the cover that overlaps the lower end of the support member.

With this arrangement the track subassembly 26 can be mounted on the building wall 12 by fastening the mounting brackets 30 to the wall above the door opening. The door is then mounted on the track 28 by sliding the rollers 20 into the open end of the track and adjusting the door with respect to the wall by rotating the hanger bolts. After assembly the support members 32 are inserted into the spaces between the offset portion 46 and the flat section 40 of the track and permanently affixed thereto by the engagement of the lock element 58 with the hole 48 in the offset portion. The track cover 34 is then mounted on the track to protect the door from the elements. A track cover cap 61 can be mounted on top of the mounting bracket and on the top of the door if desired.

Figure 3:
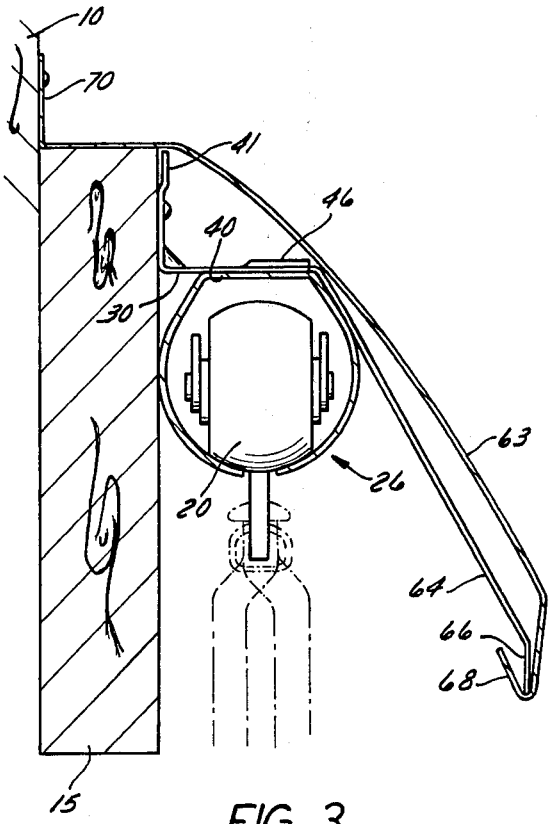
FIG. 3 is an end view of a modified form of track assembly according to the present invention.

In this regard, the track cover caps 61 can be eliminated if a track cover 63 of the type shown in the modified embodiment of the invention (FIG. 3) is used. The modified embodiment includes the same track subassembly 26 with a support member 64 having a bent section 66 at the lower end. The support member 64 includes a tab with a detent 58 as described above for locking the support member in the mounting bracket. The track cover 63 includes a lip 68 at the lower end which overlaps the section 66 and is provided with a wall section 70 that is secured to the wall above the door.

We claim:

1. A sliding door track assembly in combination with a sliding door of the type having a number of rollers mounted on the top of the door for suspending the door over an opening in a building wall, said assembly comprising a split elongate track for matingly engaging said rollers, a plurality of brackets connected at spaced intervals to the top of said track for mounting said track on the wall above said opening, each of said brackets including an offset portion spaced above said track, a separate cover support member corresponding to each of said brackets, each said support member including a tab adapted to be inserted into the space provided between the offset portion of the bracket and the top of the track to secure the support member to the bracket and an elongate track cover having a portion overhanging said door and supported by a lower end of said support member.

2. A sliding door support assembly comprising track means for supporting the door, said track means including an elongate track and a plurality of brackets secured to said track at spaced intervals for mounting said track on the wall of a building, each of said brackets including a base section and a wall section, the base section including an offset portion spaced from said track, and a plurality of separate cover support members corresponding to the plurality of brackets, each of said cover support members including a tab adapted to be inserted into the space between the offset portion of the bracket and the track to secure the support members to the bracket and an elongated track cover having a portion overhanging said door and supported by a lower end of said support members.

3. The support assembly according to claim 2 including means for locking said tab to said offset portion of said bracket.

4. The support assembly according to claim 3 wherein said lock means comprising a hole in said offset portion and a detent in said tab positioned to engage the hole in said offset portion on insertion of said tab into the space between the bracket and the track.

* * * * *